US011517958B2

(12) United States Patent
Lim et al.

(10) Patent No.: US 11,517,958 B2
(45) Date of Patent: Dec. 6, 2022

(54) PRESS PROCESS AUTOMATION SYSTEM FOR METAL PLATE USING AUTO-ROBOT

(71) Applicant: SAMSUNG TECH CO., LTD., Gyeongsan-si (KR)

(72) Inventors: Yong Taek Lim, Daegu (KR); Tae Gil Lee, Daegu (KR)

(73) Assignee: SAMSUNG TECH CO., LTD., Gyeongsan-si (KR)

( * ) Notice: Subject to any disclaimer, the term of this patent is extended or adjusted under 35 U.S.C. 154(b) by 22 days.

(21) Appl. No.: 17/099,794

(22) Filed: Nov. 17, 2020

(65) Prior Publication Data

US 2022/0088668 A1 Mar. 24, 2022

(30) Foreign Application Priority Data

Sep. 23, 2020 (KR) ..... 10-2020-0123003

(51) Int. Cl.

| | |
|---|---|
| ***B21J 13/10*** | (2006.01) |
| ***B21J 5/06*** | (2006.01) |
| ***B65H 3/08*** | (2006.01) |
| ***B65H 5/00*** | (2006.01) |

(52) U.S. Cl.

CPC ..... *B21J 5/06* (2013.01); *B21J 13/10* (2013.01); *B65H 3/0816* (2013.01); *B65H 3/0883* (2013.01); *B65H 5/002* (2013.01)

(58) Field of Classification Search

CPC ..... B21J 5/06; B21J 13/10; B65H 3/0816; B65H 3/0883; B65H 5/002

See application file for complete search history.

(56) References Cited

U.S. PATENT DOCUMENTS

| | | | | |
|---|---|---|---|---|
| 5,165,218 A * | 11/1992 | Callahan, Jr. | ..... | B65B 57/00 53/499 |
| 6,825,864 B2 * | 11/2004 | Botten | ..... | B41J 13/03 347/215 |
| 6,843,418 B2 * | 1/2005 | Jones | ..... | G07F 17/3248 235/375 |
| 2015/0133281 A1 * | 5/2015 | Hirose | ..... | G07D 7/162 493/10 |

FOREIGN PATENT DOCUMENTS

| | | | | |
|---|---|---|---|---|
| KR | 10-0579124 | * 4/2006 | ..... | B21D 43/16 |
| KR | 10-1298010 | * 8/2013 | ..... | B30B 15/30 |
| KR | 10-1810554 | * 12/2017 | ..... | B30B 15/30 |
| KR | 1020200020758 | 2/2020 | | |
| KR | 1020200080942 | 7/2020 | | |
| KR | 1020200097056 | 8/2020 | | |
| KR | 10-2174584 | * 10/2020 | ..... | B23D 15/08 |

* cited by examiner

*Primary Examiner* — Lynn E Schwenning
(74) *Attorney, Agent, or Firm* — Nicholas Park

(57) ABSTRACT

Provided is a press process automation system for a metal plate using an auto-robot. The press process automation system includes a loading unit configured to provide a stack in which a plurality of metal plates are stacked in a height direction thereof, a first robot which is coupled to the metal plate disposed on the loading unit, a table unit which is disposed at a lower position than the first target position, and determines whether the number of the metal plates is one, a second robot configured to vacuum-adsorb an upper surface of the metal plate disposed on the table unit, and a press mold unit including a lower mold which is vertically disposed at a lower position than the third target position and on which the metal plate is mounted, and an upper mold which is vertically moved from above the lower mold.

3 Claims, 7 Drawing Sheets

PRESS PROCESS AUTOMATION SYSTEM FOR METAL PLATE USING AUTO-ROBOT

CROSS-REFERENCE TO RELATED APPLICATION

This application claims priority to and the benefit of Korean Patent Application No. 10-2020-0123003, filed on Sep. 23, 2020, the disclosure of which is incorporated herein by reference in its entirety.

BACKGROUND

1. Field of the Invention

The present invention relates to a press process automation system for a metal plate in which a process of pressing a metal plate to form various types of products or parts is automated.

2. Discussion of Related Art

When products or parts are produced through a press process, the products or parts are usually produced through several processes depending on a type thereof. Here, a transfer process is required between the respective processes. Meanwhile, such a process includes a process of repeatedly supplying a metal plate of a certain shape and size with a predetermined thickness to a mold.

In the conventional press process, methods such as a method of transferring a metal plate by deploying several workers and the like have been used. However, such a work method has a problem that causes an accident. Further, the conventional press process includes manual operation and visual inspection by a worker, etc., which has a problem that causes a high defect rate due to a worker's mistake and low productivity.

Therefore, in the press process for producing various products or parts, there is an urgent need to develop a system for an automation process together with technical needs for facilities that can shorten process time, reduce costs, and improve productivity and product competitiveness.

DOCUMENT OF PRIOR ART

Patent Document

Korean Laid-Open Patent Application No. 10-2019-0014325 (Published on Feb. 7, 2019)

Korean Laid-Open Patent Application No. 10-2018-0170949 (Published on Dec. 27, 2018)

Korean Laid-Open Patent Application No. 10-2020-0019655 (Published on Feb. 18, 2020)

SUMMARY OF THE INVENTION

Embodiments of the present invention are directed to establishing a press process automation system for a metal plate by introducing various element techniques optimized for automation of products or parts formed by a press process.

In addition, the present invention is intended to reduce occurrence of accidents and defect rates for products due to mistakes of workers by minimizing deployment of workers. Accordingly, the present invention is intended to ensure operational reliability for the press process and improve overall productivity. In addition, the present invention is intended to improve management profits by reducing product costs.

In addition, the present invention is intended to facilitate a coupling relationship between components of the present system to conveniently perform maintenance and management of the components.

According to an aspect of the present invention, there is provided a press process automation system for a metal plate using an auto-robot. The press process automation system includes a loading unit configured to provide a stack in which a plurality of metal plates are stacked in a height direction thereof, a first robot which is coupled to the metal plate disposed on the loading unit, moves the metal plate to a preset first target position, and then lowers the metal plate down from the first target position, a table unit which is disposed at a lower position than the first target position, moves the metal plate to a preset second target position using an upper plate unit inclined in one direction, and determines whether the number of the metal plates is one, a second robot configured to vacuum-adsorb an upper surface of the metal plate disposed on the table unit, move the metal plate to a preset third target position, and then lower the metal plate down from the third target position, and a press mold unit including a lower mold which is vertically disposed at a lower position than the third target position and on which the metal plate is mounted, and an upper mold which is vertically moved from above the lower mold.

The loading unit may include a base unit, a stick-shaped magnetic unit formed to extend vertically upward from an upper surface of the base unit, and a stick-shaped spraying unit which is disposed on one side of the stick-shaped magnetic unit in parallel and in which a plurality of first spraying holes through which air is sprayed are formed.

The loading unit may further include a conveyor belt unit which is disposed in front of the base unit and in which a plurality of rollers are disposed in forward and rearward directions to roll and move the metal plate.

A plurality of link units may be connected to each other in the first robot so that the first robot performs multi-shaft rotation, and the first robot may further include a vacuum adsorption unit which vacuum-adsorbs the metal plate when an adsorption operation is performed in which a portion of the upper surface of the metal plate is pushed and pressed.

The vacuum adsorption unit may include a pipe-shaped finger frame unit coupled to an end portion of an arm of the first robot, a plurality of fixing brackets separately disposed below the finger frame unit, an adsorption pad unit having an upper portion coupled to pass through the fixing bracket and which is disposed perpendicularly below the finger frame unit and formed to open an air valve disposed therein when the adsorption operation is performed, and a nozzle having one end which is connected to an air head unit and the other end which communicates with an upper end of the adsorption pad unit, and through which suctioned air is moved.

The table unit may include a rectangular upper plate unit, a leg frame unit having a lower end fixedly provided to the ground and including four upper legs having different lengths on an upper portion thereof, and angle adjusting units, each of which is disposed between a lower surface of the upper plate unit and one of the upper legs and which adjust an inclination angle of the upper plate unit.

The upper plate unit may be inclined so that a first corner, which is one of four corners, is located at the lowest height, and a sidewall plate may be coupled to each of an x-axis border and a y-axis border which are adjacent to the first corner.

A photo-sensor unit may be formed in a lower space of the upper plate unit to be parallel to each of the x-axis border and the y-axis border, and the photo-sensor unit may be exposed through an empty gap between the upper plate unit and the sidewall plate.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, in descriptions of the present invention, when it is determined that detailed descriptions of related well-known functions that are obvious to those skilled in the art are deemed to unnecessarily obscure the gist of the present invention, they will be omitted. The terminology used herein is for the purpose of describing particular embodiments only and is not intended to be limiting to the present invention. As used herein, the singular forms "a," "an," and "the" are intended to also include the plural forms, unless the context clearly indicates otherwise.

It should be further understood that the terms "comprise," "comprising," "include," and/or "including," when used herein, specify the presence of stated features, integers, steps, operations, elements, parts, or combinations thereof, but do not preclude the presence or addition of one or more other features, integers, steps, operations, elements, parts, or combinations thereof.

Hereinafter, specific embodiments of the present invention will be described in detail with reference to the accompanying drawings.

Figure 1:
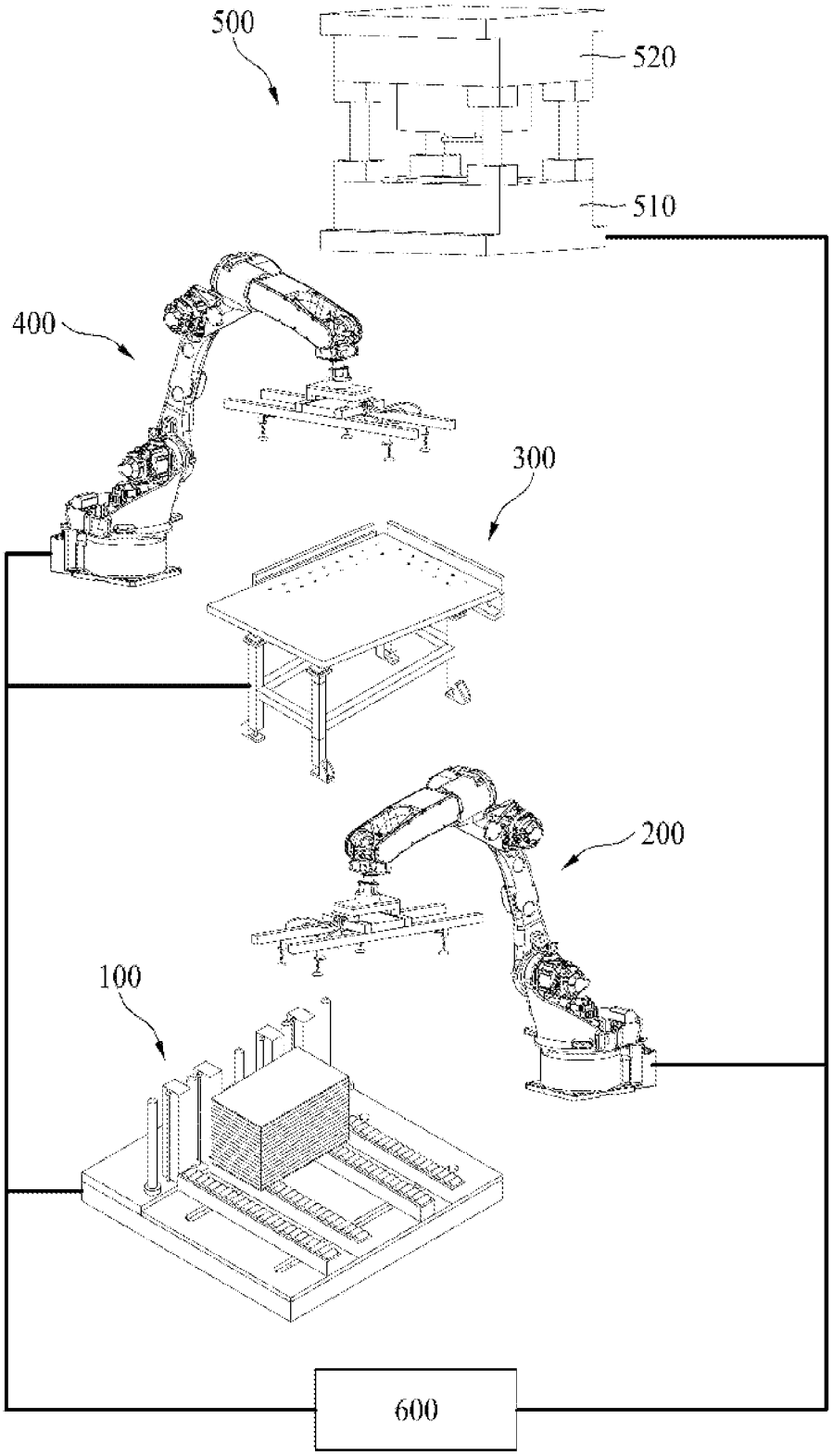
FIG. 1 is a schematic view of a press process automation system for a metal plate according to an embodiment.
Figure 2:
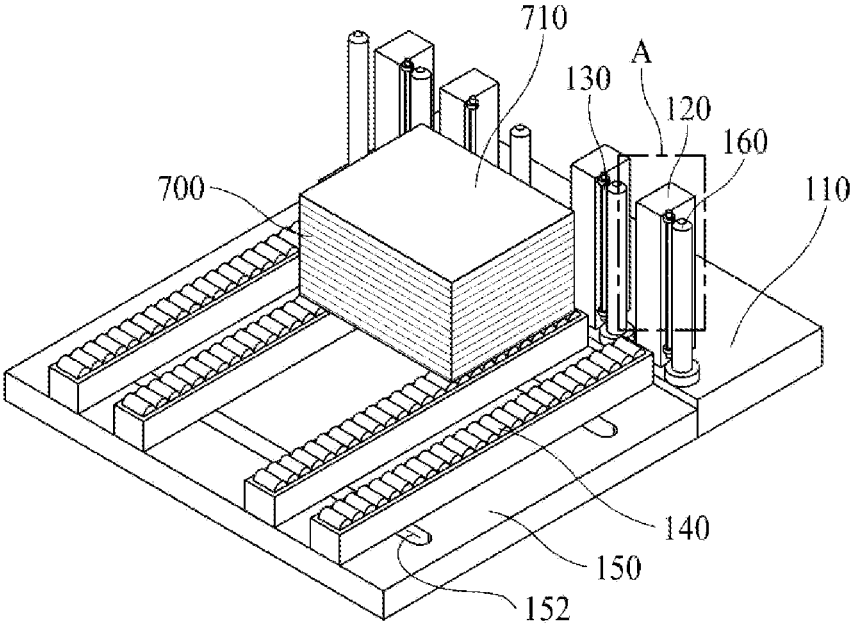
FIG. 2 is a perspective view of a loading unit of FIG. 1.
Figure 3:
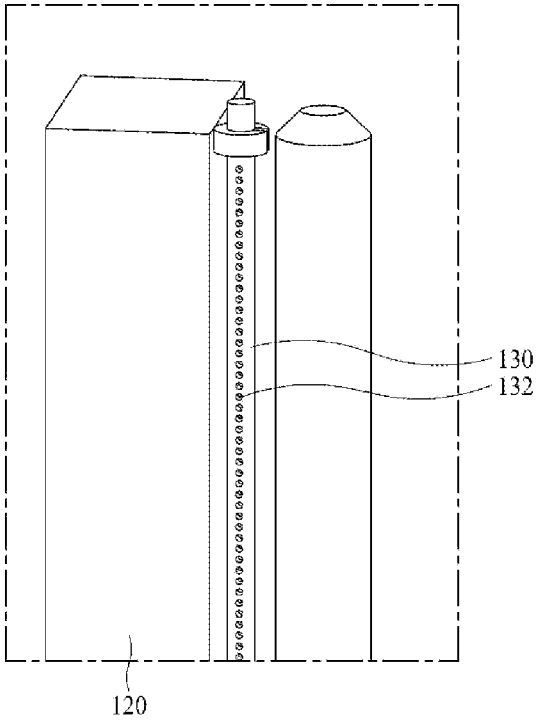
FIG. 3 is an enlarged view of a portion A of FIG. 2.
Figure 4:
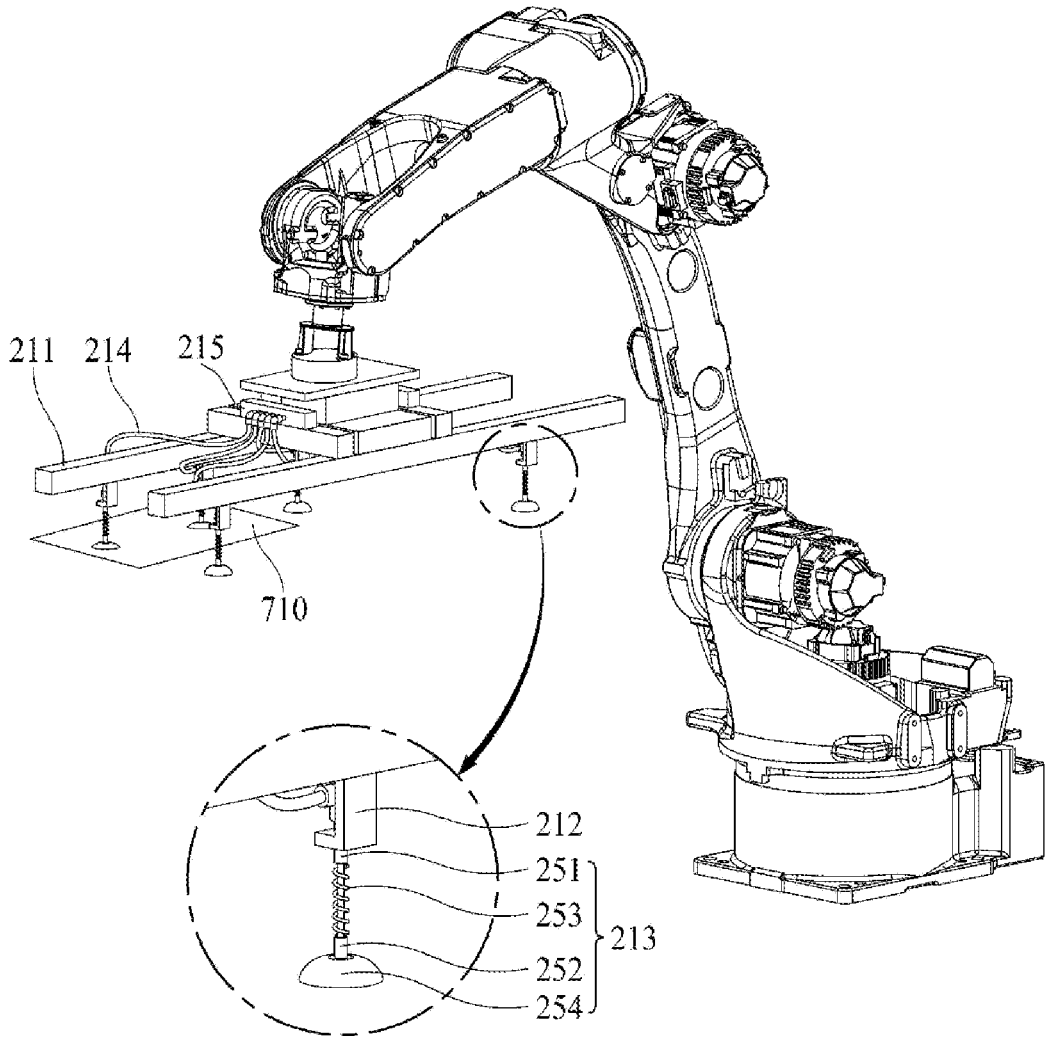
FIG. 4 is a perspective view illustrating a vacuum adsorption unit of FIG. 1.
Figure 5:
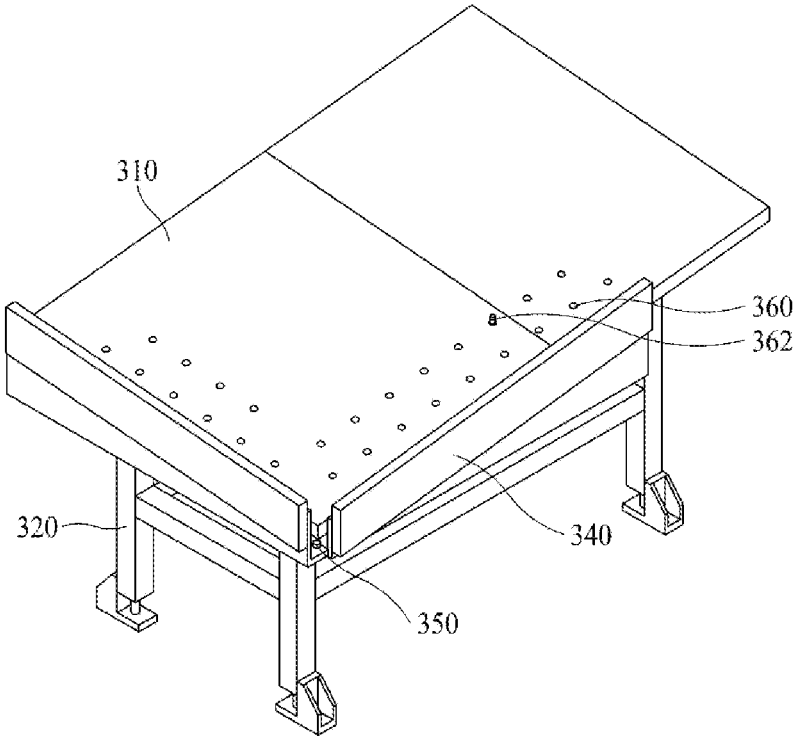
FIG. 5 is a perspective view of a table unit of FIG. 1.
Figure 6:
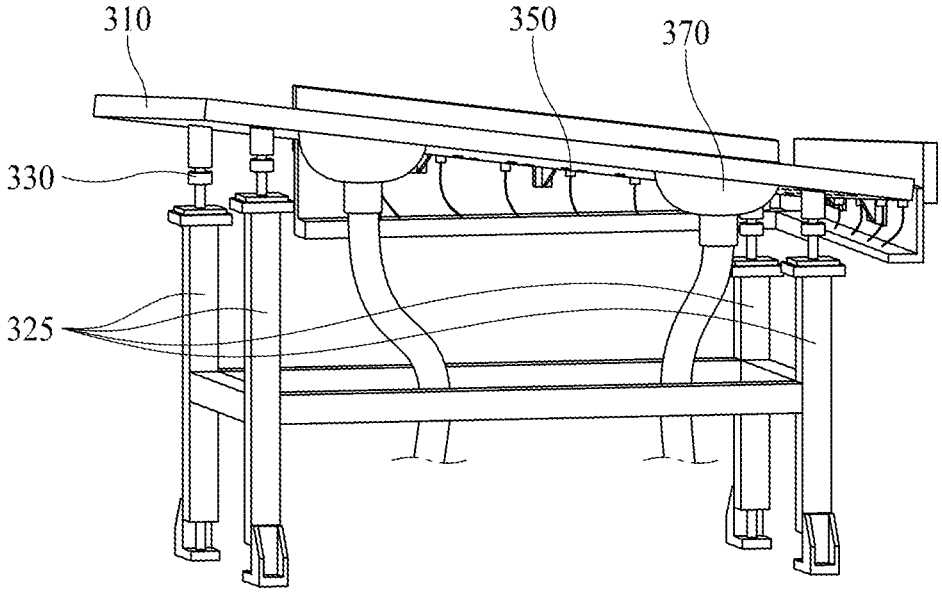
FIG. 6 is a bottom perspective view of FIG. 5.
Figure 7:
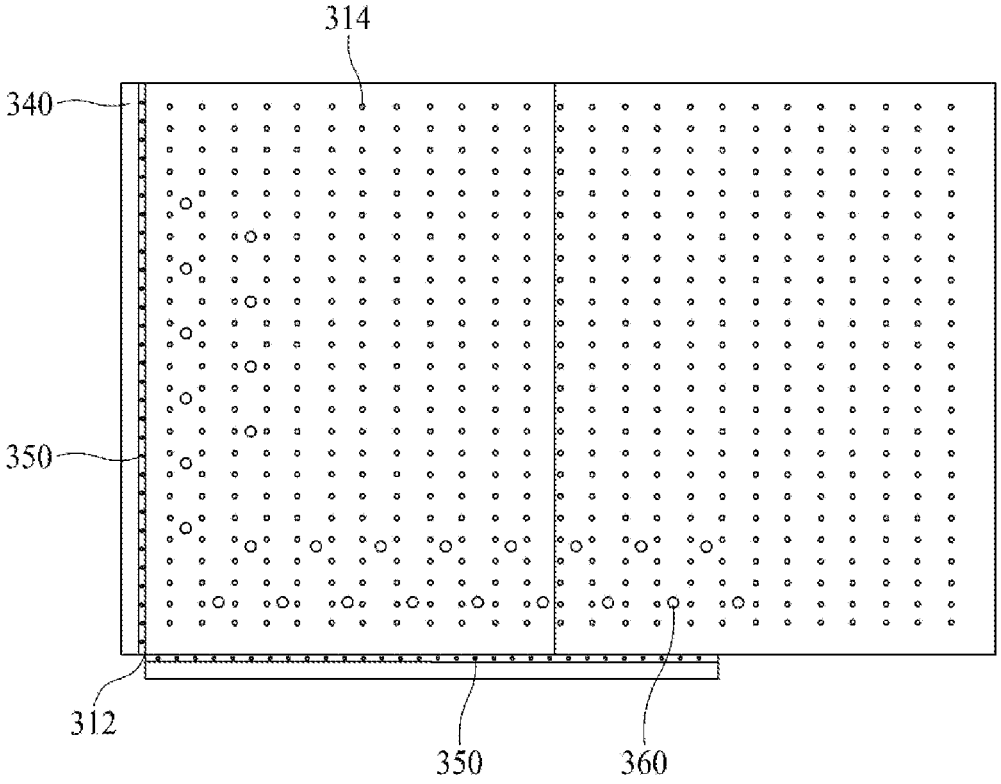
FIG. 7 is a plan view of FIG. 5.

FIG. 1 is a schematic view of a press process automation system for a metal plate according to an embodiment, FIG. 2 is a perspective view of a loading unit of FIG. 1, FIG. 3 is an enlarged view of a portion A of FIG. 2, FIG. 4 is a perspective view illustrating a vacuum adsorption unit of FIG. 1, FIG. 5 is a perspective view of a table unit of FIG. 1, FIG. 6 is a bottom perspective view of FIG. 5, and FIG. 7 is a plan view of FIG. 5.

Referring to FIGS. 1 to 7, the press process automation system for the metal plate using the auto-robot according to the embodiment of the present invention may include a loading unit 100, a first robot 200, a table unit 300, a second robot 400, a press mold unit 500, and a controller 600. The present automation system may be introduced in a specific zone such as a factory or the like. The components of the present system are densely disposed, and thus an interval between work processes may be shortened so that a takt time may be improved.

The loading unit 100 provides a stack 700 in which a plurality of metal plates 710 are stacked in a height direction thereof. Here, the metal plates 710 may be used for parts such as a car body or chassis, and the like. The metal plates 710 are cut with a predetermined size and processed and then stacked in the height direction to form the stack 700. In this case, oil is applied onto at least one of upper and lower surfaces of the metal plate 710. As a result, an oil film may be formed between the metal plates 710 which constitute the stack 700.

The loading unit 100 according to the embodiment may include a base unit 110, a stick-shaped magnetic unit 120, a stick-shaped spraying unit 130, a conveyor belt unit 140, and the like. The base unit 110 is a plate fixed to the ground. The stick-shaped magnetic unit 120 is formed to extend vertically upward from an upper surface of the base unit 110. The stick-shaped magnetic unit 120 forms a magnetic force therearound and provides a pulling force to the stack 700 formed of a metal. However, the stack 700 may not be moved only by the magnetic force of the stick-shaped magnetic unit 120 due to a weight thereof. When the stack 700 is provided to the present system through the loading unit 100, the stack 700 is moved through the conveyor belt unit 140 and moved until the stack 700 comes into contact with the stick-shaped magnetic unit 120. Meanwhile, the stick-shaped magnetic unit 120 applies the magnetic force to the stack 700 to generate fine gaps between the metal plates 710 which constitute the stack 700.

The stick-shaped magnetic unit 120 extends vertically upward. Such a stick-shaped magnetic unit 120 may be embedded in a case or the like. The stick-shaped magnetic unit 120 is preferably formed to have a height greater than a height of the stack 700 disposed on the loading unit 100. As a result, the stick-shaped magnetic unit 120 may provide the magnetic force to an entire region of a side surface of the stack 700.

The stick-shaped spraying unit 130 may be disposed on one side of the stick-shaped magnetic unit 120 in parallel, and a plurality of first spraying holes 132 are formed in the stick-shaped spraying unit 130 to allow air to be sprayed therethrough. The stick-shaped spraying unit 130 is coupled to the stick-shaped magnetic unit 120 at a predetermined interval and formed to extend parallel to the stick-shaped magnetic unit 120. In the stick-shaped spraying unit 130, the first spraying holes 132 are formed such that air is sprayed in a direction in which the stack 700 is disposed. The first spraying holes 132 are preferably arranged in a line in a longitudinal direction of the stick-shaped spraying unit 130.

Meanwhile, a hose or the like through which high-pressure air is injected is connected to a lower end of the stick-shaped spraying unit 130. The stick-shaped spraying unit 130 according to the embodiment is preferably controlled such that the air is simultaneously sprayed from all the first spraying holes 132. Further, the stick-shaped spraying unit 130 according to the embodiment is preferably controlled such that the air is sprayed during the press process using the present system.

The high-pressure air is injected into the fine gaps already formed by the stick-shaped magnetic unit 120. Accordingly, the gaps between the metal plates 710 may be further widened and such a state may be maintained. As a result, in the stack 700 in which the plurality of metal plates 710 are stacked, the metal plates 710 may be separated one by one.

The conveyor belt unit 140 is disposed in front of the base unit 110 and serves to roll and move the stack 700 in forward and rearward directions using a plurality of rollers. The conveyor belt unit 140 rolls and moves the stack 700 unloaded on one side thereof in a direction of the base unit 110 and transfers the stack 700 such that the side surface of the stack 700 may be brought into contact with the stick-shaped magnetic unit 120. Such a conveyor belt unit 140 is preferably provided with at least two conveyor belt units 140.

Meanwhile, the conveyor belt unit 140 may be disposed to be movable in left and right directions. To this end, the loading unit 100 may further include a mount unit 150 disposed below the conveyor belt unit 140 and having guide holes 152 formed to extend in the left and right directions. In this case, guide rods (not illustrated) inserted into and coupled to the guide holes 152 may be further formed on a lower surface of the conveyor belt unit 140. As a result, the conveyor belt unit 140 may be moved on an upper surface of the mount unit 150. On the other hand, the stick-shaped magnetic unit 120 and the stick-shaped spraying unit 130 may be fixedly provided on the base unit 110.

Meanwhile, the loading unit 100 may further include a stick-shaped stopper unit 160 fixedly provided on the upper surface of the base unit 110. When the stack 700 is moved to a position at which the stack 700 is brought into contact with the stick-shaped magnetic unit 120, the stick-shaped stopper unit 160 blocks the stack 700 such that the stack 700 is not rolled and moved any more, thereby restricting a final arrangement position of the stack 700. Further, the stick-shaped stopper unit 160 may prevent the stick-shaped magnetic unit 120 or the like from being damaged due to the stack 700.

The loading unit 100 allows the stack 700 used in the press process to be loaded smoothly and allows the metal plates 710 to be separated one by one, and thus overall productivity of the present system is improved and convenience of work is significantly increased.

The first robot 200 functions to move the metal plate 710 to a preset first target position by being coupled to the metal plate 710 disposed on the loading unit 100 and then lowering the metal plate 710 down from the first target position. In the first robot 200, a plurality of link units are connected to each other so that the first robot 200 performs multi-shaft rotation. In the first robot 200, a drive motor is used for each rotation shaft so that a degree of freedom of work by the multi-shaft rotation may be improved. The first robot 200 may move the metal plate 710 from one position to another position through a bending ability by a joint unit, a direction change ability by a rotation shaft, and the like.

The first robot 200 repeatedly performs a process of moving the metal plate 710 disposed on the loading unit 100 to the first target position and then lowering the metal plate 710 down from the first target position. To this end, the first robot 200 may further include a vacuum adsorption unit 210 which vacuum-adsorbs the metal plate 710 when an adsorption operation is performed in which a portion of an upper surface of the metal plate 710 is pushed and pressed. Such a vacuum adsorption unit 210 may be coupled to an end portion of an arm of the first robot 200. Meanwhile, the metal plates 710 constituting the stack 700 are sequentially moved by the first robot 200 from the metal plate 710 located at the top. Accordingly, the height of the stack 700 is gradually reduced.

When it is assumed that a point at which the first robot 200 is coupled to the metal plate 710 through the vacuum adsorption unit 210 is referred to as an original position, the original position may be changed each time. As a result, the first robot 200 recognizes the height of the stack 700 and performs the adsorption operation. To this end, the first robot 200 may be controlled such that the number of operations is changed according to the stack 700 disposed on the loading unit 100. Further, the stack 700 may be divided based on the weight, thickness, number (quantity), shape, and the like of the metal plate 710.

Meanwhile, the first robot 200 moves the metal plate 710 to the preset first target position and then lowers the metal plate 710 down from the first target position. In this case, the first target position corresponds to any spatial coordinates in a work space, and the first target position may be changed according to a type of the stack 700. The first robot 200 may precisely and repeatedly perform a process of moving the metal plate 710 from the original position to the first target position using a preset work algorithm.

The vacuum adsorption unit 210 may include a vacuum pump unit, finger frame units 211, fixing brackets 212, adsorption pad units 213, nozzles 214, and the like. The vacuum pump unit may be provided outside the first robot 200. The finger frame unit 211 has a pipe shape coupled to the end portion of the arm of the first robot 200. The finger frame unit 211 may be provided with, for example, a pair of finger frame units which are disposed facing each other. The finger frame unit 211 may be formed to have a cross section in one of various shapes such as a rectangular shape, a circular shape, and the like.

The fixing bracket 212 may be provided with a plurality of fixing brackets 212 which are separately disposed below the finger frame unit 211. The fixing bracket 212 has an L-shaped end fixed to the finger frame unit 211.

The adsorption pad unit 213 has an upper portion coupled to pass through the fixing bracket 212 and is disposed perpendicularly below the finger frame unit 211 and formed to open an air valve (not illustrated) disposed therein when the adsorption operation is performed. Specifically, the adsorption pad unit 213 may include an upper body 251, a lower body 252, an elastic connection unit 253, and an adsorption pad 254. The upper body 251 is a portion that is coupled to pass through the fixing bracket 212, and an upper channel through which air is moved is formed inside the upper body 251. The lower body 252 is a portion to which the adsorption pad 254 is fixedly provided, and a lower channel through which air is moved is formed inside the lower body 252.

The elastic connection unit 253 allows the upper channel and the lower channel to communicate with each other while connecting the upper body 251 to the lower body 252. Further, an elastic spring is disposed in the elastic connection unit 253 so that a length of the elastic connection unit 253 may be decreased or increased in a vertical direction.

The nozzle 214 has one end which is connected to an air head unit 215 and the other end which communicates with an upper end of the adsorption pad unit 213, and serves as a path through which suctioned air is moved. Further, the air head unit 215 is connected to a vacuum pump unit (not illustrated), which suctions the air, and serves to suction the air. The air head unit 215 may be coupled to the end portion of the arm of the first robot 200.

Meanwhile, the air valve is disposed inside the lower body 252 so that when the adsorption operation is performed, the elastic connection unit 253 is compressed and the air valve is opened. In this case, the nozzle 214 suctions the air so that the adsorption pad unit 213 vacuum-adsorbs the metal plate 710.

The table unit 300 is disposed at a lower position than the first target position, moves the metal plate 710 to a preset second target position using an upper plate unit 310 inclined in one direction, and determines whether the number of the metal plates 710 is one. The table unit 300 serves to assist the first robot 200 and the second robot 400 in the automation of the press process. The table unit 300 may check the metal plate 710 immediately before the metal plate 710 is moved to the press mold unit 500. That is, in order for the second robot 400 to operate, the size, shape, weight, and position of the metal plate 710 should all be checked by the table unit 300 as a prerequisite thereof. To this end, in the present system, the table unit 300 and the second robot 400 may be electrically connected to each other such that data is directly exchanged between the table unit 300 and the second robot 400. In addition, all the components of the present system may be electrically connected to each other.

The table unit 300 may include the upper plate unit 310, leg frame units 320, angle adjusting units 330, sidewall plates 340, a photo-sensor unit 350, a weight sensor unit (not illustrated), and the like. The upper plate unit 310 has, for example, a rectangular shape, and an empty space may be formed inside the upper plate unit 310. Meanwhile, the metal plate 710 lowered down by the first robot 200 is disposed on an upper surface of the upper plate unit 310.

The leg frame unit 320 may have a lower end fixedly provided to the ground and may include four upper legs 325 having different lengths on an upper portion thereof. An inclination angle of the upper plate unit 310 may be adjusted by the leg frame units 320. Meanwhile, the angle adjusting units 330 may be disposed between a lower surface of the upper plate unit 310 and the upper legs and may adjust the inclination angle of the upper plate unit 310 within a smaller range.

The table unit 300 may adjust the inclination angle of the upper plate unit 310 to a preset value using the leg frame units 320 and the angle adjusting units 330. As a result, the rectangular upper plate unit 310 is inclined such that a first corner 312, which is one of four corners, is located at the lowest height. As a result, the metal plate 710 may be slid and moved in a direction in which the first corner 312 is located after being lowered down. For example, when the metal plate 710 has a rectangular shape, the metal plate 710 may be moved to the second target position on the table unit 300 using the above corner.

Further, the sidewall plate 340 is coupled each of an x-axis border and a y-axis border which are adjacent to the first corner 312. In this case, the sidewall plates 340 may be coupled to the x-axis border and the y-axis border by being spaced apart from the x-axis border and the y-axis border (as a result, a slit-shaped empty gap is formed). The sidewall plates 340 block the metal plate 710 from being separated from the table unit 300. Particularly, when the metal plate 710 has a rectangular shape, the sidewall plates 340 guide the metal plate 710 to be easily disposed at the second target position.

The photo-sensor unit 350 may be further formed in a lower space of the upper plate unit 310 to be parallel to each of the x-axis border and the y-axis border. In this case, the photo-sensor unit 350 may be exposed through an empty gap between the upper plate unit 310 and the sidewall plates 340. To this end, a sensor bracket (not illustrated) on which the photo-sensor unit 350 is disposed may be further formed in the upper plate unit 310.

The photo-sensor unit 350 may include a plurality of sensors disposed in a line to be parallel to each of the x-axis border and the y-axis border. For example, in the photo-sensor unit 350, a first x sensor, a second x sensor, a third x sensor, and a fourth x sensor may be disposed in a line to be parallel to the x-axis border. Further, in the photo-sensor unit 350, a first y sensor, a second y sensor, and a third y sensor may be disposed in a line to be parallel to the y-axis border. When the metal plate 710 is moved to the second target position in the table unit 300, the first x sensor, the second x sensor, the third x sensor, the first y sensor, and the second y sensor may generate, for example, detection signals according to the size of the metal plate 710.

Further, a plurality of pinholes 360 may be formed in rows and columns to be parallel to the x-axis border and the y-axis border in the upper surface of the upper plate unit 310. A position of the pinhole 360 may indicate coordinates on the upper plate unit 310. Further, fixing pins 362 which fix the position of the metal plate 710 may be inserted into the pinholes 360. When the metal plate 710 has a shape other than a rectangular shape, the fixing pins 362 serve to dispose the metal plate 710 at the second target position.

Further, second spraying holes, which are disposed vertically upward and spray air upward, may be disposed in a grid shape in the upper surface of the upper plate unit 310. To this end, paths which communicate with the second spraying holes are formed inside the upper plate unit 310. Further, air inlets 370 which communicate with the paths may be formed on the lower surface of the upper plate unit 310. Meanwhile, hoses through which external air is supplied is transmitted to the air inlets 370 are connected to the table unit 300.

Further, the table unit 300 may further include the weight sensor unit which measures a weight of the metal plate 710. A user may visually recognize the weight measured by the weight sensor unit using a display unit. The weight sensor unit serves as a unit for determining whether the number of the metal plates 710 is one. Therefore, when a value of the weight measured by the weight sensor unit is out of a preset range, the operation of the present system may be temporarily stopped.

When the metal plate 710 has a weight within the preset range, the second robot 400 presses the upper surface of the metal plate 710 located on the table unit 300 and vacuum-adsorbs the metal plate 710. Thereafter, the second robot 400 moves the metal plate 710 to a preset third target position and then lowers the metal plate 710 down from the third target position. The second robot 400 performs most of the same function as the first robot 200. Therefore, detailed descriptions of portions that overlap the above-described contents will be omitted.

The second robot 400 repeatedly performs a process of moving the metal plate 710 and then lowering the metal plate 710 down from the position. To this end, the second robot 400 may further include the vacuum adsorption unit 210 which vacuum-adsorbs the metal plate 710 when the adsorption operation is performed in which the portion of the upper surface of the metal plate 710 is pushed and pressed. Since the vacuum adsorption unit 210 has been described above, a detailed description thereof will be omitted. Meanwhile, the vacuum adsorption unit 210 may be coupled to the end portion of the arm of the second robot 400. The second robot 400 may precisely and repeatedly perform a process of moving the metal plate 710 from the second target position to the third target position using a preset work algorithm. When the metal plate 710 is located at the third target position, the second robot 400 releases the vacuum state of the vacuum adsorption unit 210 to allow the metal plate 710 to be lowered down.

Meanwhile, when all conditions, such as whether the metal plate 710 is normally located at the second target position on the table unit 300 and whether the number of the metal plates 710 is one, are satisfied, the second robot 400 is operated to move the metal plate 710 to the third target position. To this end, the controller 600 receives the detection signal of each of the photo-sensor unit 350 and the weight sensor unit. Then, the controller 600 generates a command for controlling the second robot 400.

The press mold unit 500 may include a lower mold 510, an upper mold 520, and the like. The lower mold 510 is vertically disposed at a lower position than the third target position so that the metal plate 710 is mounted on the lower mold 510. When the upper mold 520 is located at a raised position, the third target position is located in a space therebetween, that is, a space between the lower mold 510 and the upper mold 520. The raised position refers to a position in which the upper mold 520 is raised vertically so that the metal plate 710 may be mounted on the lower mold 510. The upper mold 520 is vertically moved from above the lower mold 510. On the upper mold 520, a pressing surface for pressing the metal plate 710 is provided.

The controller 600 controls the loading unit 100, the first robot 200, the table unit 300, the second robot 400, and the press mold unit 500. The controller 600 may control each of the components of the present system. Meanwhile, the components of the present system are electrically connected to each other. Further, the controller 600 may integrally control the present system by processing pieces of data transmitted from the components. As a result, when a breakdown, an accident, or another error occurs in some of the components, the overall operation of the present system may be stopped. For example, when the weight of the metal plate 710 on the table unit 300 is out of the preset range, the present system may be temporarily stopped.

According to the solutions of the present invention as described above, various effects including the following effects can be expected. However, all of the following effects are not necessary to establish the present invention.

In the press process automation system for the metal plate according to the embodiment of the present invention, various element techniques optimized for automation can be introduced to products or parts that are formed by a press process.

Further, by minimizing deployment of workers, occurrence of accidents and defect rates for products due to mistakes of workers can be reduced. Accordingly, operational reliability for the press process can be ensured and overall productivity can be improved. Further, management profits can be improved by reducing product costs. Further, by facilitating a coupling relationship between components of the present system, it is possible to conveniently maintain and manage each component.

In the above, the exemplary embodiments of the present invention have been described in a descriptive sense only. However, the scope of the present invention is not limited to such specific embodiments and may be appropriately changed within the scope described in the appended claims.

What is claimed is:

1. A press process automation system for a metal plate using an auto-robot, the press process automation system comprising:

a loading unit including a base unit; a stick-shaped magnetic unit formed to extend vertically upward from an upper surface of the base unit; and a conveyor belt unit which is disposed in front of the base unit and in which a plurality of rollers are disposed in forward and rearward directions to roll and move the metal plate;

a first robot configured to hold the metal plate disposed on the loading unit, to move the metal plate to a table unit and then to release the metal plate on the table unit;

the table unit including an upper plate unit inclined in one direction so that a first corner, which is one of four corners, is located at the lowest height and a sidewall plate is coupled to each of an x-axis border and a y-axis border which are adjacent to the first corner, wherein the table unit configured to move the metal plate to a direction in which the first corner is located to determine whether the number of the metal plates is one;

a photo-sensor unit which is formed in a lower space of the upper plate unit to be parallel to each of the x-axis border and the y-axis border, wherein the photo-sensor unit is exposed through an empty gap between the upper plate unit and the sidewall plate, wherein the photo-sensor unit is visually recognized above the upper plate unit;

a second robot configured to vacuum-adsorb an upper surface of the metal plate disposed on the table unit, to move the metal plate to a press mold unit, and then to release the metal plate on the press mold unit; and the press mold unit including a lower mold on which the metal plate is mounted, and an upper mold which is vertically moved from above the lower mold, wherein the first robot further includes a vacuum adsorption unit which vacuum-adsorbs the metal plate when an adsorption operation is performed in which a portion of the upper surface of the metal plate is pushed and pressed, wherein the vacuum adsorption unit includes:

a pipe-shaped finger frame unit coupled to an end portion of an arm of the first robot; a plurality of fixing brackets separately disposed below the finger frame unit; an adsorption pad unit having an upper portion coupled to pass through the fixing bracket and which is disposed perpendicularly below the finger frame unit and formed to open an air valve disposed therein when the adsorption operation is performed; and a nozzle having one end, which is connected to an air head unit, and the other end, which communicates with an upper end of the adsorption pad unit, and through which suctioned air is moved, wherein the adsorption pad unit includes:

an upper body that is coupled to pass through the fixing bracket, the upper body forming an upper channel through which air is moved inside the upper body;

a lower body to which the adsorption pad is fixedly provided, the lower body forming a lower channel through which air is moved inside the lower body; and an elastic connection unit allowing the upper channel and the lower channel to communicate with each other while connecting the upper body to the lower body, wherein the elastic connection unit includes an elastic spring, and nozzle suctions, wherein the elastic spring is disposed in the elastic connection unit so that a length of the elastic connection unit is decreased or increased in a vertical direction, wherein the air valve is disposed inside the lower body so that when the adsorption operation is performed, the elastic connection unit is compressed and the air valve is opened, wherein the nozzle suctions the air so that the adsorption pad unit vacuum-adsorbs the metal plate, wherein the second robot operates when the size, shape, weight, and position of the metal plate in the table unit are all checked, the table unit and the second robot are electrically connected to each other such that data is directly exchanged between the table unit and the second robot.

2. The press process automation system of claim 1, wherein the loading unit includes:

a stick-shaped spraying unit which is disposed on one side of the stick-shaped magnetic unit in parallel and in which a plurality of first spraying holes through which air is sprayed are formed.

3. The press process automation system of claim 1, wherein the table unit includes:

a rectangular upper plate unit;

a leg frame unit having a lower end fixedly provided to the ground and including four upper legs having different lengths on an upper portion thereof; and angle adjusting units, each of which is disposed between a lower surface of the upper plate unit and one of the upper legs and which adjust an inclination angle of the upper plate unit.

* * * * *